US005975158A

United States Patent [19]

Gordon et al.

[11] Patent Number: 5,975,158

[45] Date of Patent: Nov. 2, 1999

[54] METHOD FOR PREVENTING BULGE OF LIQUID PACKAGING

[75] Inventors: Robert L. Gordon, Monroe, N.Y.; Xiang Yu, Paramus, N.J.

[73] Assignee: International Paper Company, Tuxedo Park, N.Y.

[21] Appl. No.: 09/131,749

[22] Filed: Aug. 10, 1998

[51] Int. Cl.[6] ..... B65B 3/16

[52] U.S. Cl. ..... 141/114; 141/18; 141/2; 141/168; 141/369; 53/469; 53/449

[58] Field of Search ..... 141/1, 2, 18, 98, 141/129, 168, 171, 172, 369, 370, 390, 391; 53/473, 467, 469, 374.8, 525, 526, 499; 366/114; 100/232, 244

[56] References Cited

U.S. PATENT DOCUMENTS

| | | | |
|---|---|---|---|
| 2,161,071 | 5/1939 | McGrath et al. | 53/449 |
| 2,329,311 | 6/1943 | Waters | 53/449 |
| 2,481,611 | 9/1949 | Moore . | |
| 2,821,827 | 2/1958 | Shaw et al. . | |
| 2,904,945 | 9/1959 | Kerr . | |
| 4,458,469 | 7/1984 | Dunn . | |
| 4,905,450 | 3/1990 | Hansen et al. | 53/469 |
| 5,237,797 | 8/1993 | Varlet . | |
| 5,339,604 | 8/1994 | Aarts . | |
| 5,428,943 | 7/1995 | Balcombe . | |

*Primary Examiner*—Steven O. Douglas
*Assistant Examiner*—Khoa D. Huynh
*Attorney, Agent, or Firm*—Hoffman, Wasson & Gitler

[57] ABSTRACT

A method for preventing bulges in liquid packaging. Disclosed is a mechanical process for squeezing the carton during the carton sealing process. When sealed, a partial vacuum is created, thus making the filled and sealed carton side walls concave. Over an extended period of time, the vacuum will release to the point of having a straight wall carton.

10 Claims, 4 Drawing Sheets

METHOD FOR PREVENTING BULGE OF LIQUID PACKAGING

BACKGROUND OF THE INVENTION

The invention is concerned with preventing the bulging of side walls in liquid packaging. More particularly, the invention is directed to a fill process which producing concave side walls which forces liquid into the carton head space preventing carton distortion outward.

The use of paperboard packaging for liquid products in gable top contains causes container bulge problems. The bulge on the sidewalls of the carton results in loss of sales and perception by the consumer that the product is spoiled.

It is an object of the present invention to provide an economical solution to the bulge problem.

It is a further object of the present invention to provide a filling process for liquid packaging wherein sidewalls are mechanically squeezed to produce a resultant concave shape.

It is a further object of the present invention to produce and provide a filled and sealed carton which will retain shape and over time result in a straight walled carton.

Additional objects and advantages may become apparent from the details of the process as more fully hereinafter described.

SUMMARY OF THE INVENTION

The present invention provides a process for filling a carton whereby at least one side wall of the carton has a resultant concave shape. The filling machine mechanically squeezes at least one carton wall during the carton top sealing process. When sealed, a partial vacuum is created thus making and retaining at least one carton side wall concave. Over an extended period of time, the side walls will relax and the vacuum will release to the point of having a straight wall carton during the sell period.

BRIEF DESCRIPTION OF THE DRAWINGS

The invention will now be further explained, by way of example only, with reference to the accompanying drawings in which.

DETAILED DESCRIPTION OF THE INVENTION

Figure 1:
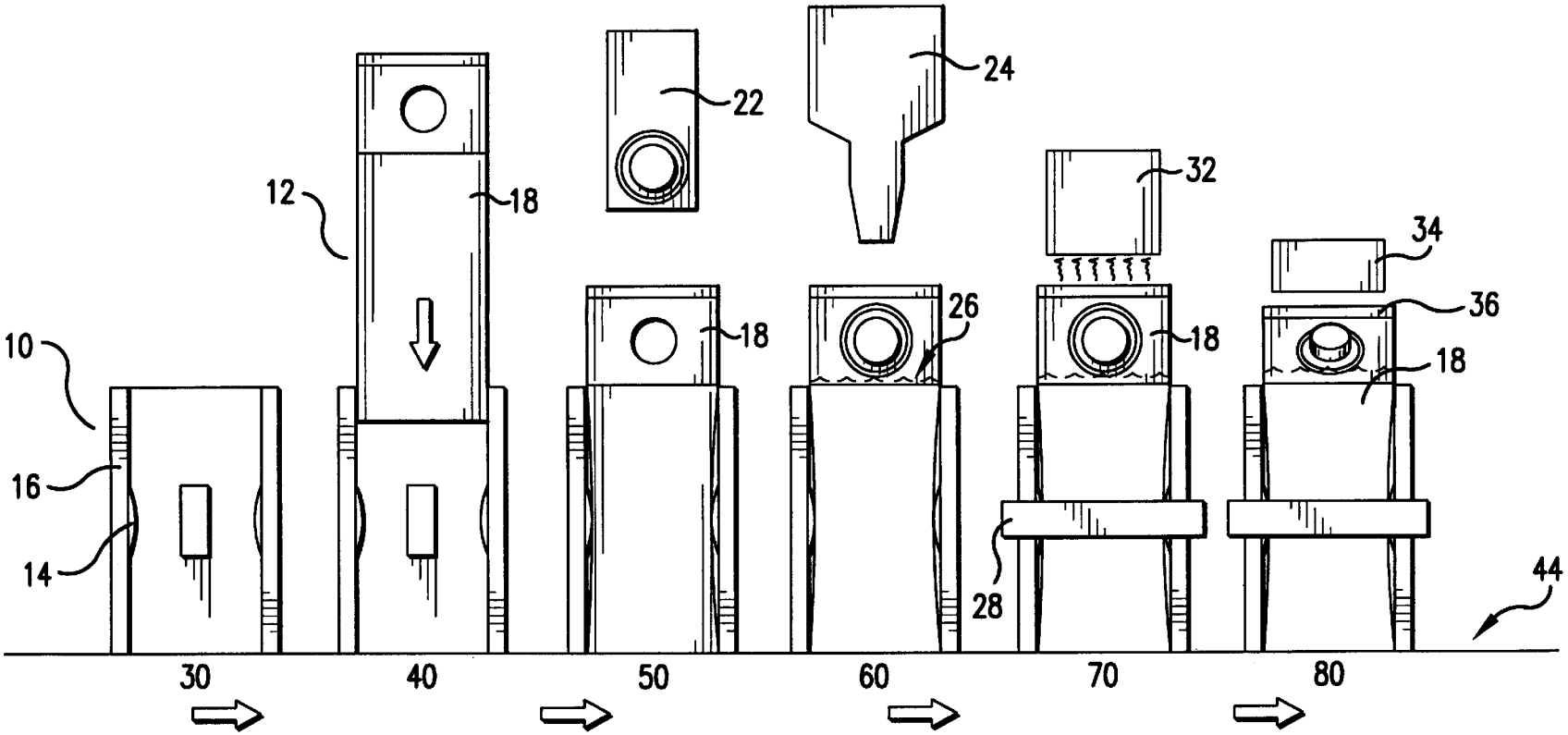
FIG. 1 is a schematic illustration of apparatus for performing the method of the present invention.
Figure 2:
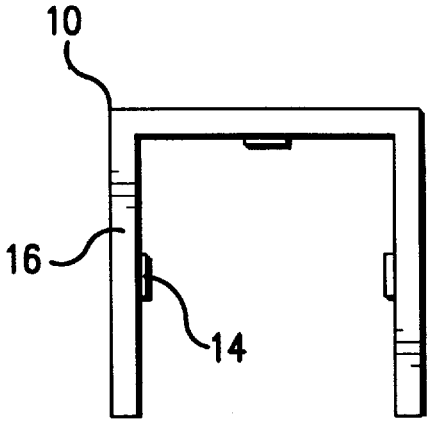
FIG. 2 is a top view of an empty conveyor station of the method having spring loaded compressors.
Figure 3:
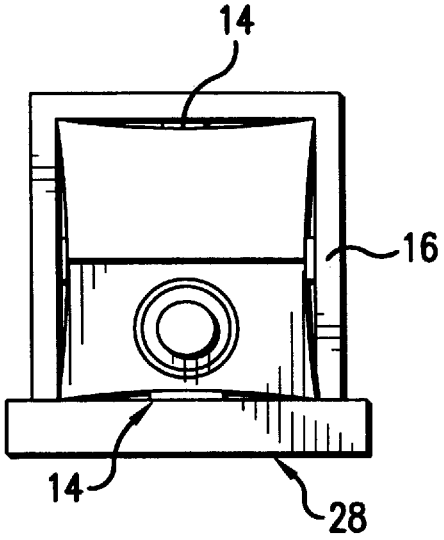
FIG. 3 is a top view of a conveyor station of the method having a filled and sealed carton contained therein and a fixed bar attached to maintain compression.

During the normal carton sealing and filling process, the paperboard blank is bottom formed and sealed and moved via pockets or flights on the conveyor chain. The cartons are contained in these pockets or flights 10 to insure they index correctly during filling and top sealing functions of the machine. The pockets or flights 10 are the structural backbones that house the cartons 12 which are filled, shaped and top sealed.

Spring-loaded pressure points 14 are placed on at least one of the carton sidewalls, and in a preferred embodiment along each of the four carton side walls.

The first station 30 illustrates an empty conveyor flight or cavity 10. The conveyor flight or cavity has spring-loaded compression units 14 placed on at least one of its side walls 16. The spring-loaded compression units are preferably convex in shape. The second station 40 is for loading an empty container or carton 18 into the conveyor flight 10. Third station 50 is optional, and is for attaching a fitment attachment 22 to the top of a gable top carton 18. The next station 60 is for the product fill 24. The liquid lever 26 coincides with the top of the carton side wall. At station five 70, a fixed bar 28 is pressed against the carton 18 during the carton sealing process. Top seal heaters 32 are provided for the sealing.

Finally, at station six, compression chill bars 34 are utilized for finalizing the top seal of the carton 18.

Figure 4:
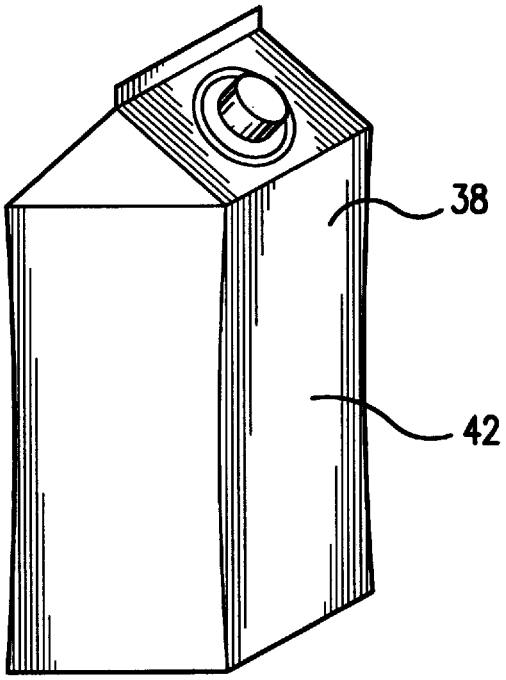
FIG. 4 is a perspective view of a finished filled package with concave walls embodying the invention.

FIG. 4 illustrates a finished filled package 38 having concave side walls 42.

When the container or carton is discharged from the conveyor 44, the carton or container is no longer supported causing a partial vacuum inside the container. The side walls are initially concave. When the vacuum is released over time during storage and distribution, the side walls become straight.

Figure 5:
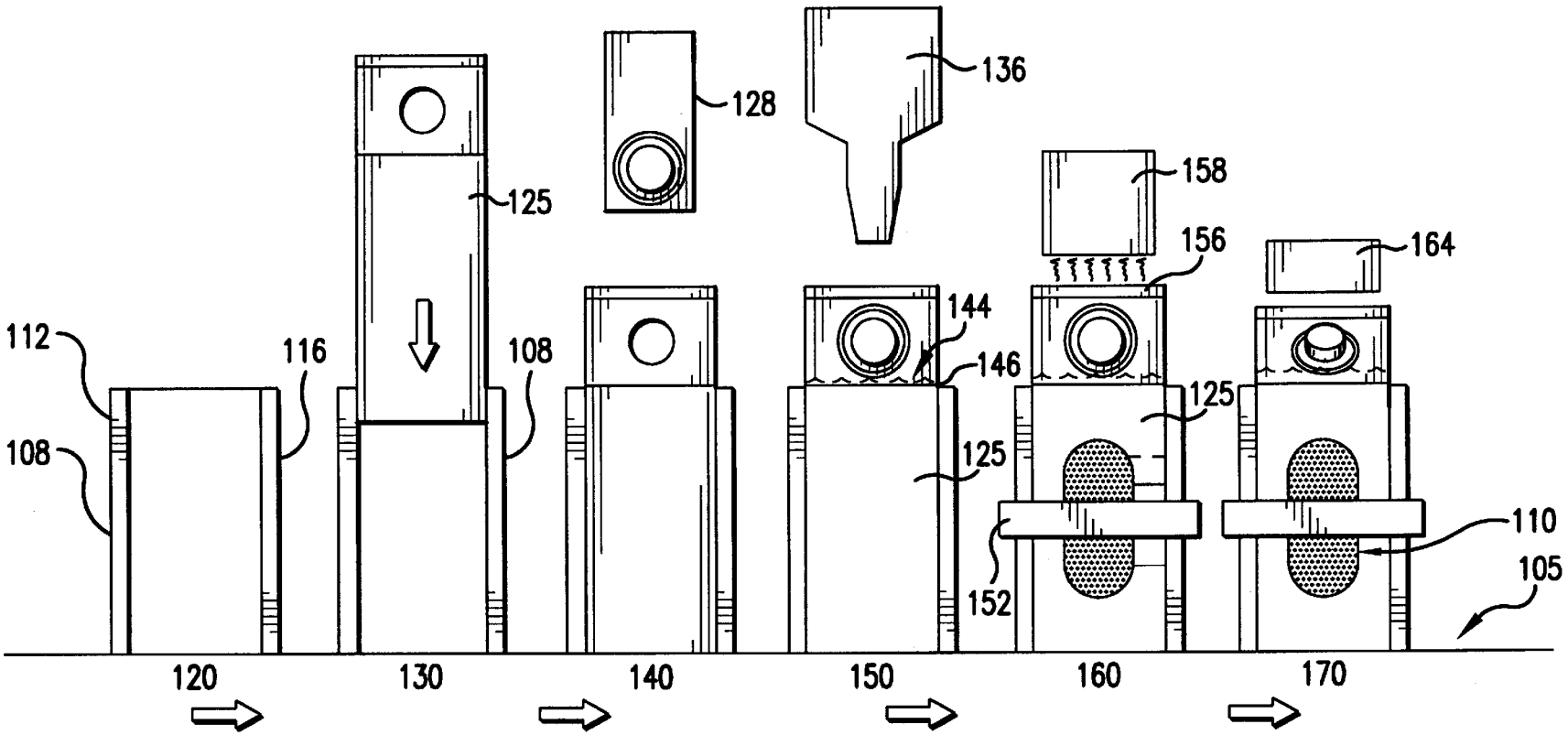
FIG. 5 is a schematic illustration of an apparatus for performing an alternate embodiment of the method of the present invention.
Figure 6:
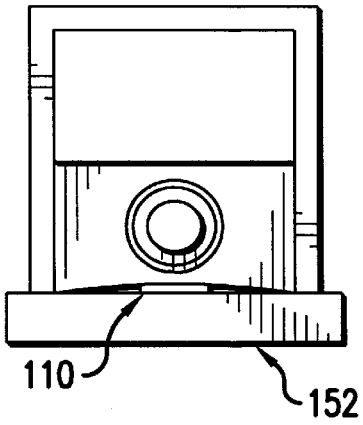
FIG. 6 is a top view of an empty conveyor station of the alternate embodiment of FIG. 7.
Figure 7:
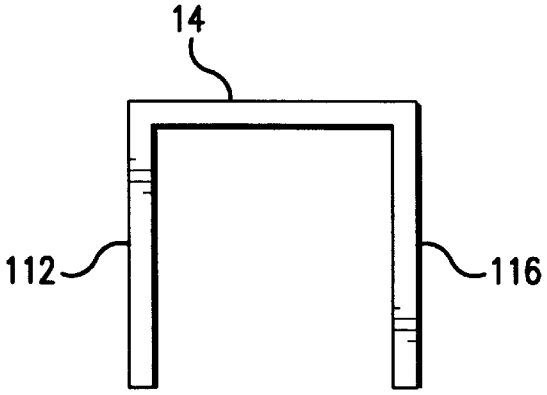
FIG. 7 is a top view of a conveyor station of the alternate embodiment of the method of FIG. 7, having a filled and sealed carton contained therein and a fixed bar with a convex compression pad to create a concave wall of the carton.

In FIG. 5, there is depicted an alternate embodiment of the method embodying the present invention. The second method depicted in FIG. 5, along conveyor 105 requires only a single pressure or compression pad or bar 110 at the top sealing stations 160 and 170. Empty conveyor flight or cavity 108 has three side walls 112, 114 and 116, respectively. The second station 130 is for loading an empty bottom sealed carton 125 into a conveyor flight or cavity 108.

Station three 140 is optional, and is for a fitment attachment 128. Station four 150 is where product fill 136 occurs. The carton 125 is filled to a liquid lever 144 equal to the side wall height 146.

Figure 8:
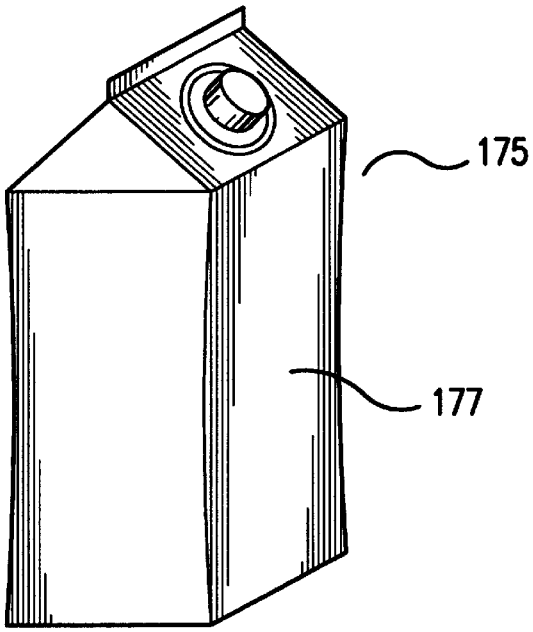
FIG. 8 is a perspective view of a finished filled carton with concave walls embodying the inventive method of FIG. 7.

The flight reaches station five wherein a fixed bar 152 having a compressor bar 110, preferably convex, affixed thereto, is pressed against the container 125 during the sealing process of the carton top 156, via top seal heaters 158. At station six 170, compression chill bars 164, complete the top seal resulting in a filled container 175 (see FIG. 8) having at lest one concave side wall 177. If desired, each side wall 112, 114 and 116 may have a convex compression bar attached thereto (now shown). This bar can be placed midway up the side of each flight side wall.

The compression bar 152 can be replaced by a plunger device that is activated by a cam action.

The foregoing is illustrative of the principals of the invention. As other embodiments and modifications may occur to those skilled in the art, the description is not limiting to the scope of the invention and all suitable modification and equivalents are to be considered within the scope of the invention.

What is claimed is:

1. A method for preventing bulge of liquid packaging comprising the steps of:

a) placing a carton having side walls into a filling station;

b) exerting pressure on at least one side wall making said at least one side wall concave prior to filling;

c) filling said carton with a liquid; and d) sealing a top of said carton while maintaining the pressure on said at least one side wall of said carton to produce filled liquid packaging wherein the carton when removed from the filling station has at least one concave side wall.

2. A method for preventing bulge of liquid packaging as claimed in claim 1, wherein said pressure is exerted midway up said at least one side wall of said carton.

3. A method for preventing bulge of liquid packaging as claimed in claim 1, wherein said pressure is exerted by at least one spring-loaded convex compression unit.

4. A method for preventing bulge of liquid packaging as claimed in claim 1, wherein said filled liquid packaging has four concave side walls.

5. A method for preventing bulge of liquid packaging comprising the steps of:

a) placing a carton having side walls into a filling station;

b) filling said carton with a liquid to form a filled carton;

c) placing said filled carton into a compression station, wherein a compression bar is pressed against at least one side wall of said filled carton to form at least one concave side wall of said filled carton; and d) sealing a top of said carton while maintaining the pressure on said at least one side wall of said carton to produce said liquid packaging wherein the carton when removed from the filling station has at least one concave side wall.

6. A method for preventing bulge of liquid packaging as claimed in claim 5, wherein said compression bar is convex.

7. A method for preventing bulge of liquid packaging as claimed in claim 5, wherein said compression bar is pressed against a midsection of said at least one side wall of said filled carton.

8. A method for preventing bulge of liquid packaging as claimed in claim 5, wherein said filled carton has four concave side walls.

9. A method for preventing bulge in liquid packaging comprising the steps of:

a) placing a carton having side walls into a filling station;

b) filling said carton with a liquid to form a filled carton;

c) placing said filled carton into a preparation station wherein a plunger activated by a cam action passes against at least one sidewall of said filled carton to form at least one concave side wall of said filled carton; and d) sealing a top of said filled carton, to produce liquid packaging with at least one concave side wall.

10. A method for preventing bulge in liquid packaging as claimed in claim 9, wherein said plunger is convex.

* * * * *